US005425981A

United States Patent [19]

Brüning et al.

[11] Patent Number: 5,425,981

[45] Date of Patent: Jun. 20, 1995

[54] SEMIFINISHED TAPE PRODUCT COMPRISING UNIDIRECTIONALLY ORIENTED REINFORCING AND MATRIX FIBERS AND PRODUCTION AND USE THEREOF

[75] Inventors: Hans-Joachim Brüning, Augsburg; Ingolf Jacob, Untermeitingen, both of Germany

[73] Assignee: Hoechst Aktiengesellschaft, Germany

[21] Appl. No.: 121,985

[22] Filed: Sep. 15, 1993

Related U.S. Application Data

[63] Continuation of Ser. No. 791,005, Nov. 12, 1991, abandoned.

[30] Foreign Application Priority Data

Nov. 14, 1990 [DE] Germany ..... 40 36 265.5

[51] Int. Cl.[6] ..... B32B 27/14; B32B 31/16; D04H 1/04

[52] U.S. Cl. ..... 428/198; 156/73.2; 156/155; 156/166; 156/209; 428/294; 428/296; 428/297; 428/373

[58] Field of Search ..... 428/294, 198, 296, 374, 428/373, 375, 297; 156/73.2, 155, 166, 209

*Primary Examiner*—James D. Withers
*Attorney, Agent, or Firm*—Connolly & Hutz

[57] ABSTRACT

There is described a tape comprising unidirectionally oriented reinforcing and thermoplastic fibers composed of yarns of reinforcing and/or thermoplastic fibers, the yarn density being about 5 to 20 yarns/cm of width and the yarns having a linear density of about 1000 to 3000 dtex, the matrix fibers having been locally incipiently or completely melted on at least one of the tape surfaces to form consolidation points. The tape is suitable as a starting material for producing composite materials.

11 Claims, 3 Drawing Sheets

Figure 1A:
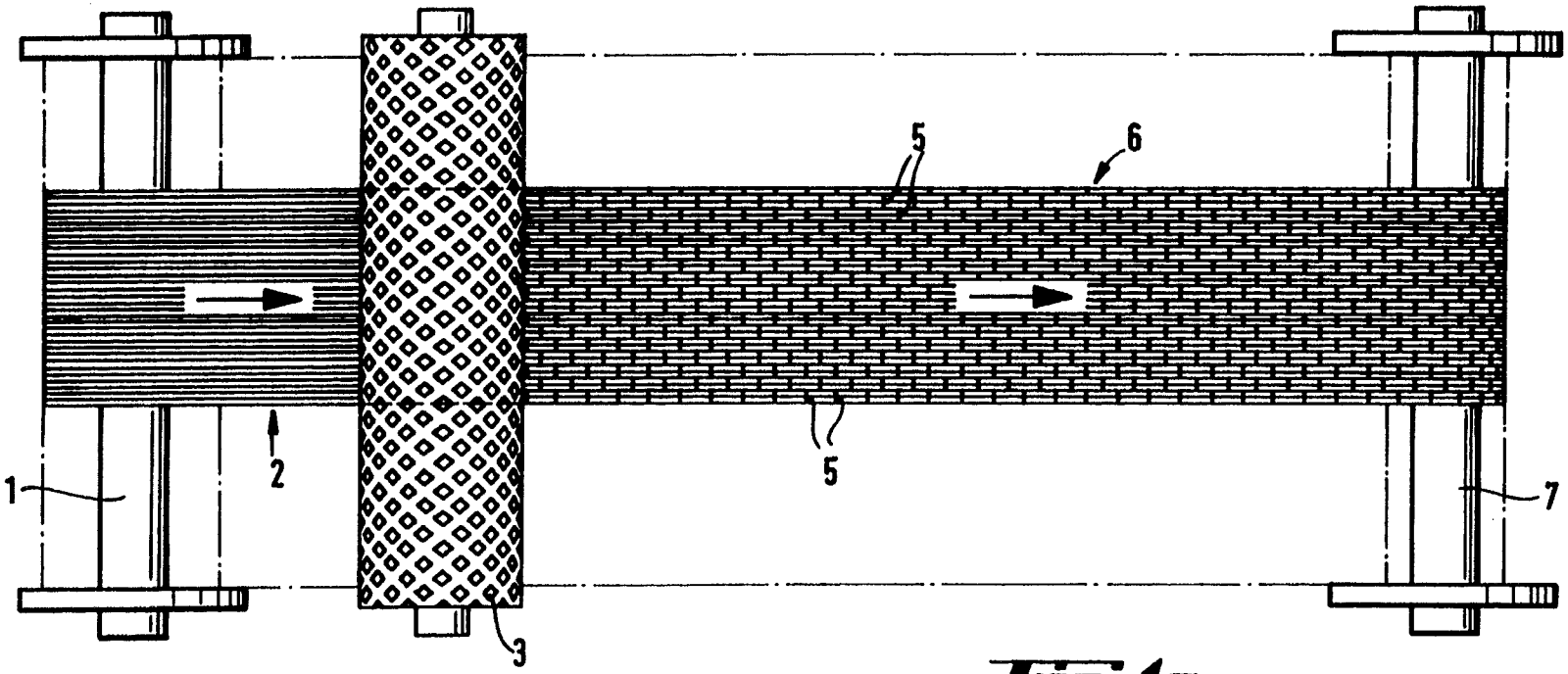

SEMIFINISHED TAPE PRODUCT COMPRISING UNIDIRECTIONALLY ORIENTED REINFORCING AND MATRIX FIBERS AND PRODUCTION AND USE THEREOF

CROSS-REFERENCE TO RELATED APPLICATION

The present application is a continuation of application Ser. No. 07/791,005, filed Nov. 12, 1991, now abandoned.

The present invention relates to semifinished tape products which are suitable for producing composite materials, more particularly for producing fiber reinforced thermoplastics.

It is already known to produce fiber reinforced thermoplastics from semifinished stock in the form of tapes of reinforcing fibers which have been melt impregnated with thermoplastic material. Such semifinished products are stiff and do not possess the drapability of textile sheet materials.

DE-C 23 20 133 discloses webs composed of unidirectionally arranged carbon fibers, which have been impregnated with adhesive and which are held together by thermoplastic filaments, arranged perpendicular to the carbon fibers, having been fused onto these fibers. DE-U-85 21 108 describes textile reinforcements for producing layered structures composed of longitudinal and transverse thread layers. In these structures, the number of cross-over points between warp and weft threads is kept to a minimum. This is achieved there through an arrangement of superposed longitudinal and transverse thread layers which are joined together by additional longitudinal threads made of a thermoplastic material. Further forms of textile reinforcements are described in EP-B-193 478, EP-B-193 479 and EP-B-198 776. EP-A-144 939 discloses a composite material composed of warp and weft threads of reinforcing fibers, wherein the warp and/or weft threads have been wrapped with filaments of a thermoplastic material which on heating welds together the reinforcing fibers.

These embodiments all have in common that they contain threads in different alignments.

Furthermore, DE-A-18 08 286 discloses nonwovens which consist of random laid filaments or fibers and which comprise at least one thermoplastic polymer material. These nonwovens are characterized in that in each one of them part was subjected to a process of consolidation, a certain number of bonding points having been created in this part per unit area with a certain cross-sectional area at the bonding point tips. Consolidating itself is achieved for example by treating the web with a heated press which possesses a textured surface.

Finally, DE-A-34 08 769 discloses a process for producing fiber reinforced molded articles from a thermoplastic material using flexible textile structures consisting of substantially unidirectionally or parallel oriented reinforcing fibers and of a matrix composed of thermoplastic yarns or fibers. The structures described are essentially fabrics knitted from these fibers, or bundles or tapes. These semifinished products are not shaped until their ultimate shaping using heatable profile dies, in the course of which virtually all thermoplastic fibers are melted.

There have now been found novel semifinished textile products which possess good drapability and are processible in particular in textured compression molds. The semifinished products according to the invention exhibit an essentially homogeneous distribution between the various kinds of fiber and the orientation of the reinforcing fibers is substantially unidirectional. The drapability of the semifinished product according to the invention corresponds approximately to that of a woven or knitted fabric of the same sheet weight produced from these fibers but has the advantage compared with a woven or knitted fabric that the fibers are unidirectionally oriented and there is thus no need for the fibers to be oriented by drawing in the course of the downstream thermal shaping process.

The invention provides a tape comprising essentially unidirectionally oriented reinforcing fibers and thermoplastic matrix fibers, which is composed essentially of yarns which contain reinforcing fibers and/or matrix fibers, which has a yarn density of about 5 to 20 yarns/cm of width, and wherein the yarn linear density is about 1000 to 3000 dtex and the matrix fibers have been locally incipiently or completely melted on at least one tape surface to form consolidation points.

For the purposes of the present invention the term "yarn" is to be understood as meaning multifilament yarns, staple fiber yarns, compound/combination yarns composed of multifilaments and staple fibers, and also monofilaments. The term "fiber" is herein to be understood as meaning not only staple fibers but also continuous filaments.

The yarn density of the tape is chosen to be such that the spacing of the yarns making up the tape is not too wide, so that it is still possible to form consolidation points between adjacent yarns. Ordinarily the spacing of the yarns in the tape should be less than about three times the diameter of a monofilament having a linear density equal to that of the yarns. The linear density of the reinforcing and/or matrix fiber yarns used is in general from 1000 to 3000 dtex, preferably from 1500 to 2500 dtex.

Reinforcing fibers and matrix fibers can be present not only in the form of separate yarns but also as compound/combination yarns. Furthermore, it is also possible to use bicomponent fibers composed of reinforcing and matrix components. Within the yarns the reinforcing fibers are preferably present in the form of multifilaments. Very particular preference is given to using compound/combination yarns composed of reinforcing and matrix fibers.

Compound/combination yarns can be produced in any conventional manner, for example ring or 3-cylinder spinning, comingling techniques, union thread production or DREF techniques.

Particular preference is given to using multifilament combination yarns composed of reinforcing and matrix fibers wherein at least some of the yarn consists of high modulus monofilaments having an initial modulus of more than 50 GPa, in particular than 80 GPa, and which are obtainable by intermingling by means of an intermingling medium, preferably air, high modulus monofilaments having been preheated to a temperature of from 0.25 Tm to 0.9 Tm prior to intermingling and the intermingling taking place at a temperature at which the matrix fibers remain essentially intact; in particular the intermingling is carried out in an unheated intermingling medium. Here Tm is the melting point or decomposition temperature of the high modulus monofilaments, in °C.

These particularly preferred multifilament combination yarns have an average entanglement spacing of the yarn, measured in the pin count test, of less than 150 mm and fewer than 20 broken monofilament ends per meter, measured by the light barrier method on one side of the yarn.

As reinforcing fibers it is possible to use virtually any infusible or high melting, high modulus and/or high tenacity fibers. These fibers are chosen in such a way that they do not melt or become plastic under the processing conditions suitable for the thermoplastic fiber portions, and are present in the resulting composite material as reinforcing fibers.

Examples of such fibers are glass fibers, carbon fibers, fibers made of a wide range of metals and metal alloys, or a wide range of metal nitrides or carbides, metal oxide fibers, and fibers made of organic polymers, such as polyacrylonitrile, polyesters, aliphatic and aromatic polyamide or polyimide.

Preference is given to using glass, carbon, metal and aramid fibers.

As thermoplastic material it is possible to use any material which is reversibly thermoplastically processible. Examples thereof are metals and metal alloys, glasses and in particular organic materials. The organic materials are in particular solvent-free or solvent-containing but preferably solvent-free known organic thermoplastic molding materials.

Examples of thermoplastics are chain growth polymers, such as vinyl polymers, e.g. polyolefins, polyvinyl esters, polyvinyl ethers, polyacrylates, polymethacrylates, poly(aromatic vinyl), polyvinyl halides, and also the various random, block and graft copolymers, liquid crystal polymers, mixed polymers or polyblends. Specific representatives are: polyethylenes, polypropylenes, polybutenes, polypentenes, polyvinyl chloride grades, polymethyl methacrylates, poly(meth)acrylonitrile grades, modified or unmodified polystyrenes or multiphase plastics such as ABS. Also polyaddition, polycondensation, polyoxidation or cyclization polymers, LC polymers, such as polyamides, polyurethanes, polyureas, polyimides, polyesters, polyethers, polyhydantoins, polyphenylene oxides, polyphenylene sulfide, polysulfones, polycarbonates, and also their mixed forms, mixtures and combinations with other polymers or polymer precursors, for example nylon-6, nylon-6.6, polyethylene terephthalates or bisphenol-A polycarbonate.

However, the polymers mentioned can also serve as reinforcing fiber material if they are processed together with lower melting fibers which according to the invention act as thermoplastic portions.

The filaments or staple fibers making up the yarns may have a virtually round cross-section or else possess other shapes, for example a dumbbell, kidney, triangular or tri- or multilobal cross-section. It is also possible to use hollow fibers.

Especially as thermoplastic fibers it is also possible to use bi- or multicomponent fibers, for example of the core/sheath or the side/side type or the matrix/fibril type.

The semifinished product according to the invention has been consolidated by local melting of the matrix fibers to such an extent that it is easily handlable without losing its tape shape but at the same time possesses good drapability, rollability and transportability. The semifinished product according to the invention has an almost unlimited and unrestricted storability, since virtually no hardening components are present. The consolidation points are situated on at least one surface of the tape but may also be situated on both surfaces. And it may be sufficient in a particular case that the tape is stabilized at the surface only.

However, it is also possible for the local consolidation points to extend virtually through the cross-section of the entire tape. The essential aspect of all these embodiments is that the melting of the matrix fibers takes place locally and that the individual matrix fibers and/or reinforcing fibers are freely movable between any two consolidation points. The average free spacing between two fixing points is preferably about 1 to 5 cm.

The density of the consolidation points along the surface will depend inter alia on the nature and amount of the thermoplastic fibers and on the mixing ratio of thermoplastic and reinforcing fibers. It is also possible to apply a pattern of consolidation points to the tape, i.e. to provide only parts of the surface of the tape with consolidation points.

Customary values for the density of consolidation points, based on unit area of tape surface, vary within the range from 40 to 500 000 points/$m^2$ of surface area, preferably from 100 to 40 000 points/$m^2$ of surface area (if consolidation points are applied to only one surface; if they are applied to both surfaces, half as high a density per surface is in general sufficient). Preferably, one consolidation point binds a plurality of reinforcing yarns.

The volume ratio of the reinforcing to the matrix fibers in the semifinished product according to the invention is freely choosable within wide limits. For instance, the volume content of the reinforcing fibers can be for example 10 to 90% and the volume content of the matrix fibers accordingly from 90 to 10%. Preferably, the volume content of the reinforcing fibers is 20–80%, in particular 40–70%.

Preferred embodiments of the semifinished product according to the invention are represented in claims 2 to 7.

The semifinished product according to the invention can be produced by a) preparing a tape arrangement of essentially unidirectionally oriented reinforcing fibers and of thermoplastic matrix fibers in the form of a warp set of yarns, and b) locally producing on at least one of the surfaces of this arrangement elevated temperatures, alone or combined with elevated pressures, so that the matrix fibers incipiently or completely melt in these areas to form local consolidation points.

The process likewise forms part of the subject matter of the present invention. The production of locally elevated temperatures can be effected by treating the tape arrangement by means of heated embossing rolls. More particularly, the yarn tape can be guided through between two embossing rolls, in particular between a roll having a smooth surface and a roll having a completely or partially textured surface. However, locally elevated temperatures may also be produced in any other desired manner, for example by the action of hot gas streams or of heated stampers or of ultrasound or high frequency electromagnetic radiation (high frequency welding).

These last two embodiments are particularly preferred, since they make it possible to produce a virtually unlimited number of patterns of consolidation points, for example by guiding the heat sources over the surface along predetermined paths and by systematically switching the heat source on and off. This may be controlled for example by means of a computer.

FIGS. 1*a*, 1*b*, 2*a* and 2*b* depict two embodiments of the process according to the invention by way of example.

Figure 3:
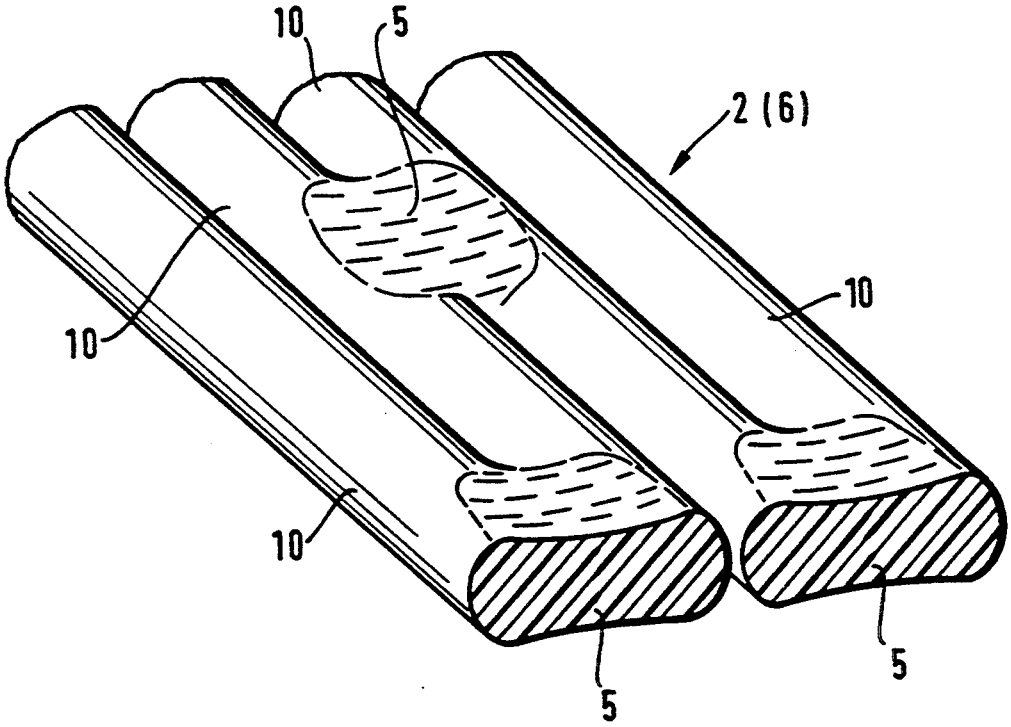

FIG. 3 depicts an embodiment of the semifinished product according to the invention by way of example.

Figure 1B:
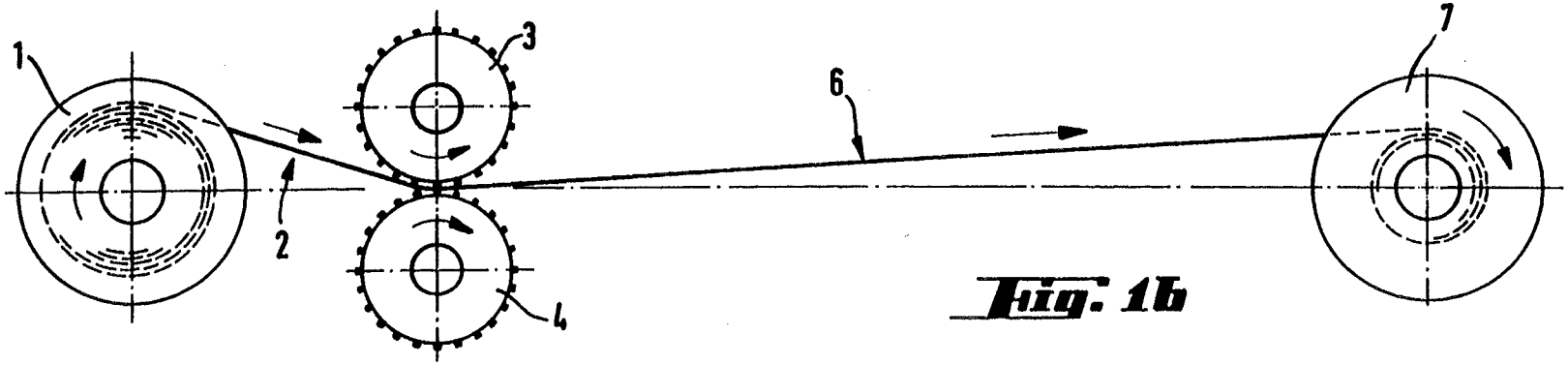

FIG. 1*a* is a plan view of an embodiment, while FIG. 1*b* is a side elevation of the same embodiment.

A warp beam (1) unwinds into a unidirectional yarn sheet (2) (FIG. 1*a* shows only part of the entire warp beam length) consisting of at least one type of thermoplastic fiber, such as polyester, polyethylene, polyamide, polyphenylene sulfide, polypropylene, polyether imide, polyether ketone, polysulfone or partially halogenated polyolefin fiber, and at least one type of reinforcing fiber, such as glass, carbon, metal, ceramic or aramid fiber.

The unidirectional yarn sheet (2) passes between two heated embossing rolls (3) and (4). One of these rolls can also have a smooth surface. The effect of pressure and heat in the areas of the raised portions of the embossing roll causes local melting of the thermoplastic fiber and hence the formation of melt fusion points between two or more mutually adjacent warp yarns. On leaving the domain of the embossing rolls (3) and (4) the melt zones solidify and produce a positive bond between these warp yarns.

FIG. 1*a* shows these solidified local melt zones (5) as striations. After consolidation, the tape (6) can be wound up on a roll (7).

Figure 2A:
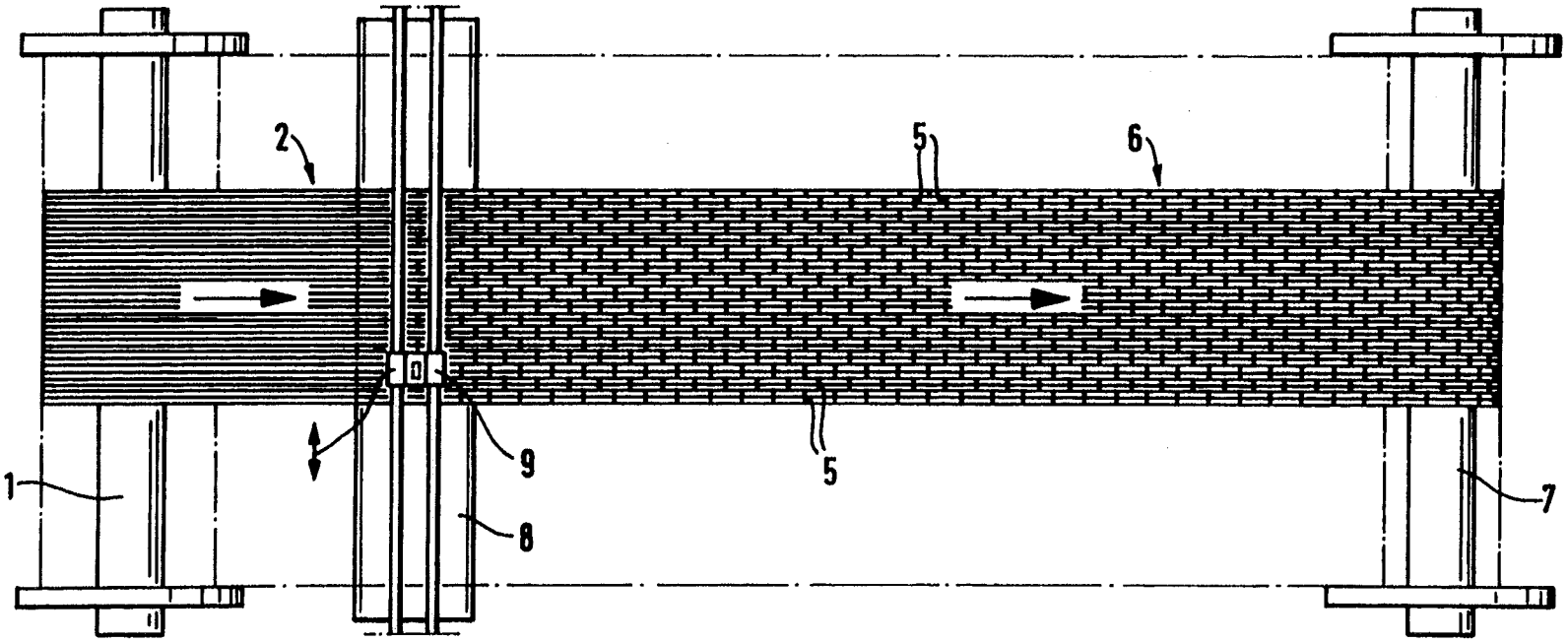
Figure 2B:
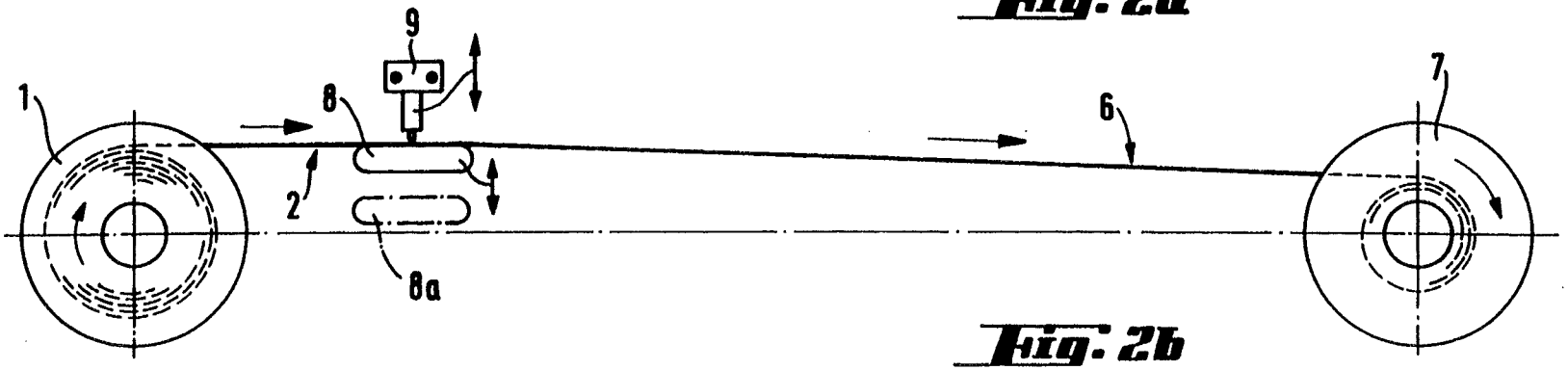

FIG. 2*a* shows a further embodiment in plan view, while this embodiment is shown in FIG. 2*b* in a side view.

A warp beam (1) unwinds into a unidirectional yarn sheet (2) (FIG. 2*a* depicts only part of the entire warp beam length) comprising at least one type of thermoplastic fiber, for example those fibers mentioned by way of example in the description of FIG. 1*a*.

The unidirectional yarn sheet (2) passes between a suitable base (8) and the pointwise melting unit (9). Such a pointwise melting unit can be for example an ultrasonic probe, a hot gas supply, a heated stamper or an electromagnetic energy source. The melting unit is movable parallel to the warp beam axis and in the vertical direction, which operations plus the switching of the energy supply on and off may be computer controlled. Similarly, the use of a plurality of melting units on one base is possible as is the use of a plurality of combinations comprising melting unit(s) and base(s) in succession. In this way it is possible to achieve a higher throughput through the installation.

The support(s) can be vertically movable (8*a*) in order to minimize the diameter differences between warp beam and roll (7).

The influence of heat in the areas under the influence of the melting unit (9) causes local melting of the thermoplastic fiber and hence the formation of melt fusion points between two or more mutually adjacent warp yarns. On leaving the domain of the melting unit (9) the melt zones solidify and produce a positive bond between these warp yarns.

FIG. 2*a* shows the solidified local melt zones (5) as striations. After solidification, the tape (6) can be wound up on a roll (7).

FIG. 3 depicts an embodiment of the semifinished product according to the invention. The tape (6) is composed of a yarn sheet (2). The yarns used in this embodiment are compound yarns (10) formed from reinforcing and matrix fibers. The tape (6) has solidified local melt zones (5) where pairs of mutually adjacent yarns have been bonded together.

What is claimed is:

1. A tape consisting of unidirectionally oriented yarns consisting of about 10 to 90 volume percent reinforcing fibers and about 90 to 10 volume percent thermoplastic matrix fibers, said tape having a yarn density of about 5 to 20 yarns/cm of width, and wherein the yarn linear density is about 1000 to 3000 dtex and the matrix fibers have been locally incipiently or completely melted on at least one tape surface to form consolidation points.

2. The tape of claim 1, composed of a mixture of yarns made of reinforcing fibers and yarns made of matrix fibers.

3. The tape of claim 1, composed of a compound-/combination yarn made of reinforcing and matrix fibers.

4. The tape of claim 1, composed of bicomponent fibers having a reinforcing and matrix component.

5. The tape of claim 1, wherein the consolidation points are arranged in a periodically repeating pattern.

6. The tape of claim 1, wherein the consolidation points are randomly distributed over the tape surface.

7. The tape of claim 1, wherein the consolidation points account for about 5 to 50% of the surface area of the tape.

8. A process for producing the tape of claim 1, comprising the steps of:

a) preparing an arrangement of essentially unidirectionally oriented reinforcing fibers and of thermoplastic matrix fibers in the form of a warp set of yarns, and b) locally producing on at least one of the tape surfaces elevated temperatures, with or without elevated pressures, so that the matrix fibers incipiently or completely melt in these areas to form local consolidation points.

9. The process of claim 8, wherein the formation of local consolidation points is effected by means of a heated embossing roll.

10. The process of claim 9, wherein the formation of local consolidation points is effected by means of ultrasound or high frequency electromagnetic radiation.

11. A method for producing composite materials said method comprises heating a tape according to claim 1 to effect melting of the thermoplastic matrix fibers to form the matrix of said composite material.

* * * * *